United States Patent [19]

Lebensfeld

[11] Patent Number: 4,593,618

[45] Date of Patent: Jun. 10, 1986

[54] TOY VEHICLE WITH STAMP

[75] Inventor: Steven Lebensfeld, New York, N.Y.

[73] Assignee: H-G Toys, Inc., Long Beach, N.Y.

[21] Appl. No.: 703,145

[22] Filed: Feb. 19, 1985

[51] Int. Cl.[4] ..... B41F 13/10

[52] U.S. Cl. ..... 101/375; 101/405; 446/465

[58] Field of Search ..... 101/375, 376, 377, 368, 101/405, 328, 329, 330, 331; 446/465

[56] References Cited

U.S. PATENT DOCUMENTS

| | | | |
|---|---|---|---|
| 518,118 | 4/1894 | Rose | 101/375 |
| 894,961 | 8/1908 | Landau | 101/330 |
| 2,691,936 | 10/1954 | Farkas et al. | 101/35 |
| 2,785,626 | 3/1957 | Brown et al. | 101/329 X |
| 3,146,707 | 9/1964 | Sloane | 101/329 |
| 3,465,673 | 9/1969 | Oppenheim | 101/377 X |

*Primary Examiner*—Clifford D. Crowder

*Attorney, Agent, or Firm*—Seidel, Gonda, Goldhammer & Abbott

[57] ABSTRACT

A toy vehicle having a body housing and undercarriage secured thereto. The undercarriage supports rotatable front and rear wheels. A roll support member is pivotably coupled to the undercarriage and is latchable thereto. An applicator roll which is adapted to carry messages, symbols or the like is rotatably supported by the roll support member. The applicator roll is displaceable between operative and inoperative positions by a cam which is turned by a key.

13 Claims, 7 Drawing Figures

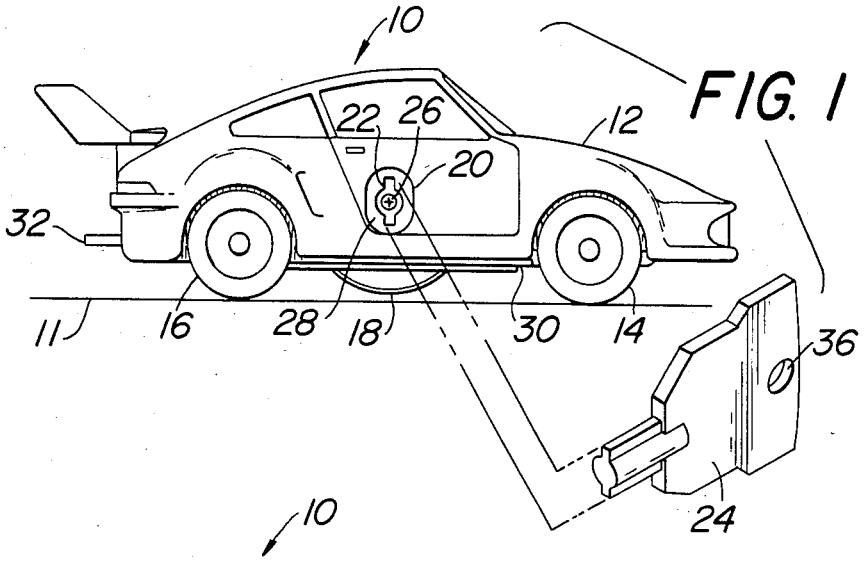
FIG. 1
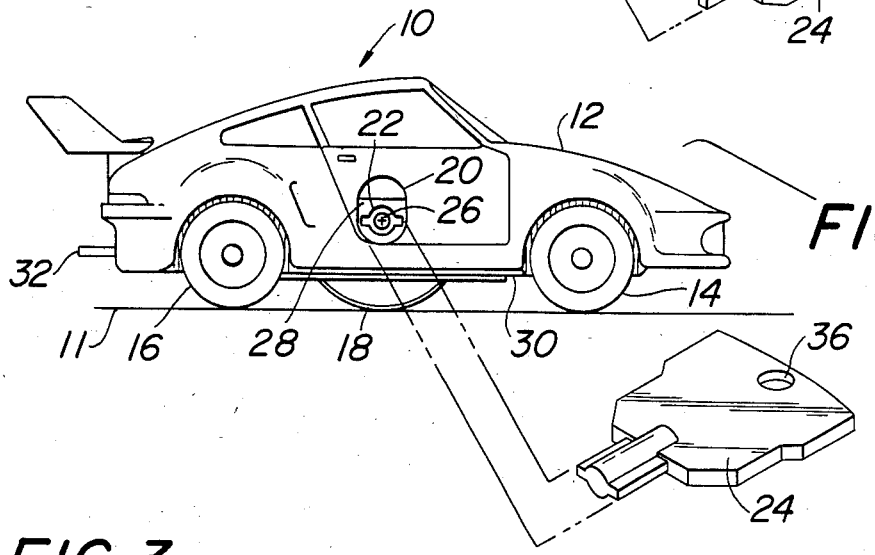
FIG. 2
FIG. 3
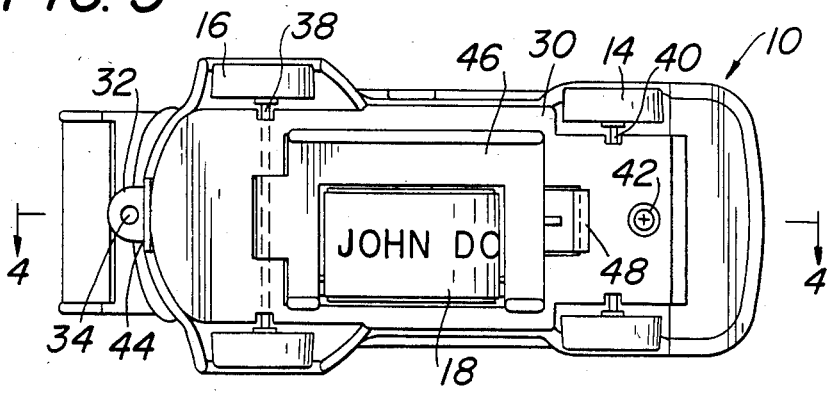

FIG. 4
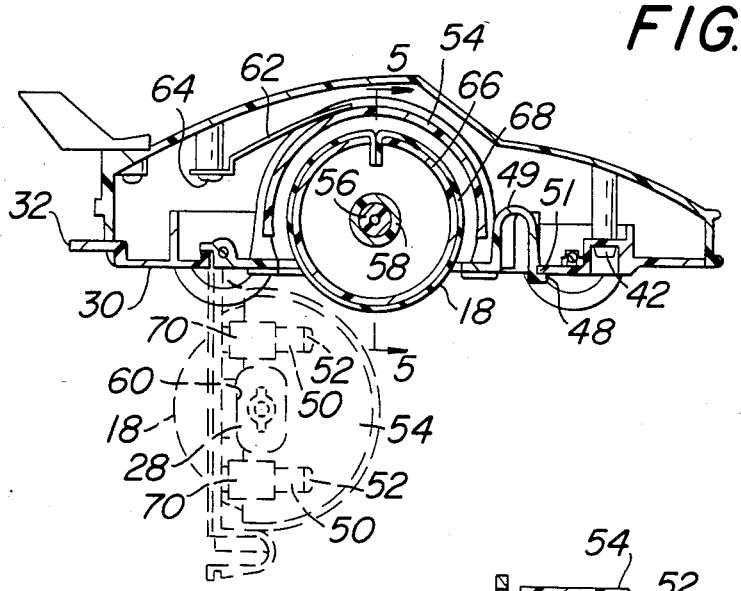
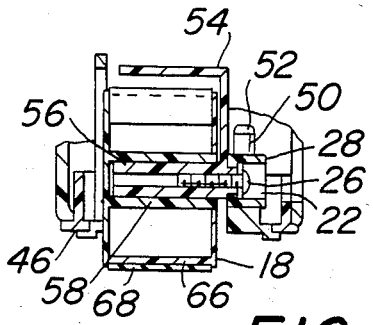
FIG. 5
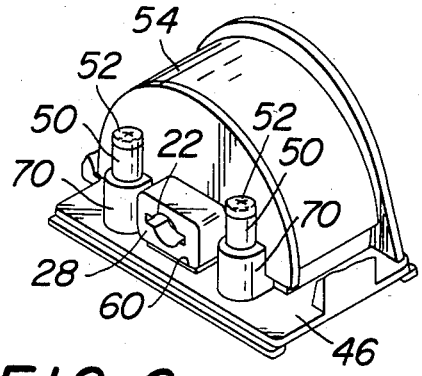
FIG. 6
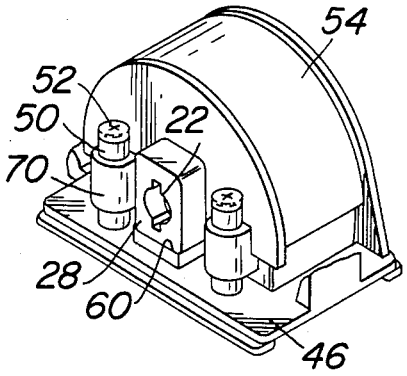
FIG. 7

TOY VEHICLE WITH STAMP

BACKGROUND OF THE INVENTION

The present invention is related to a toy vehicle, particularly a toy vehicle having a stamp.

The stamp of this toy vehicle may carry messages, decorative symbols or the like which may be transferred to surfaces when the stamp is inked. The toy vehicle with stamp may be used as a simple push toy.

An object of this invention is to provide a toy vehicle having a stamp.

A further object of this invention is to provide a toy vehicle which has an operative and inoperative position for the stamp.

A still further object of this invention is to provide a toy vehicle which children of all ages will enjoy.

Another object of this invention is to provide a toy vehicle which has a removable and interchangable stamp.

Still another object of this invention is to provide a toy vehicle which is simple, easy-to-use and safe.

Another object of this invention is to provide a toy vehicle which is easy and inexpensive to manufacture.

SUMMARY OF THE INVENTION

The present invention is a toy vehicle having a body housing. An undercarriage is secured to the body housing. Front and rear wheels are rotatably mounted on the undercarriage. A roll support member is located on and latchable to the undercarriage between the front and rear wheels. An applicator roll is supported for rotation about a horizontal axis by the roll support member. Means on the roll support member are provided for selectively elevating the applicator roll between operative and inoperative positions.

DETAILED DESCRIPTION OF THE DRAWINGS

A further description of the present invention will be apparent from the appended descriptions and drawings in which;

FIG. 1 is a side elevation of the present invention showing the applicator roll in an inoperative position and a key for selectively elevating the applicator roll.

FIG. 2 is a side elevation of the present invention showing the applicator roll in an operative position and the key for selectively elevating the roll.

FIG. 3 is a bottom view of the present invention.

FIG. 4 is a section taken along lines 4—4 in FIG. 3 wherein the roll support member is shown at two positions as represented by solid and phantom lines.

FIG. 5 is a section of the roll support member taken along lines 5—5 in FIG. 4, certain parts being broken away for clarity.

FIG. 6 is an isometric of the roll support member showing a cam horizontally aligned, certain parts being broken away for clarity.

FIG. 7 is an isometric of the roll support member showing the cam vertically aligned.

For the purpose of illustrating the invention, there is shown in the drawings a form which is presently preferred; it being understood, however, that this invention is not limited to this precise arrangement and instrumentalities shown.

DETAILED DESCRIPTION OF THE INVENTION

Referring to the drawings, wherein like numerals indicate like elements there is shown in FIGS. 1 and 2, a toy vehicle 10 having an applicator roll 18 displaceable between operative and inoperative positions. The applicator roll 18 when in the inoperative position (FIG. 1) is not in contact with a surface 11. The applicator roll 18 when in the operative position (FIG. 2) is yieldingly urged into contact with surface 11.

In FIG. 1, a key 24 is shown associated with a keyway 22 formed in a cam 28. The key 24 is vertically aligned for insertion in the similarly oriented keyway 22. The vertical alignment of key 24 and keyway 22 correspond to the applicator roll 18 being in the inoperative position. In FIG. 2, the key 24 and keyway 22 are shown aligned in a horizontal orientation, which corresponds to the applicator roll 18 being in the operative position.

The toy vehicle 10 has a body housing 12. See FIGS. 1–3. The body housing 12 has a slot 44 located at the rear of the toy vehicle 10. An undercarriage 30 is fastened to the body housing 12 by means of a retaining screw 42 and a tongue 32 which is received in slot 44.

Front wheels 14 and rear wheels 16 are mounted on the undercarriage 30 by means of front axle 40 and rear axle 38, respectively. The front and rear wheels 14 and 16 and their corresponding axles 38 and 40 are journaled within bearings on the undercarriage 30. The axles 38 and 40 are freely rotatable within their bearings.

The body housing 12 has an opening 20. See FIGS. 1–2. Opening 20 is generally rectangular having rounded corners. The opening 20 is located on a side of the body housing 12 between front and rear wheels 14 and 16. The opening allows the passage of key 24 through the body housing to keyway 22.

A roll support member 46 is pivotably mounted on rear axle 38. The roll support member 46 is located between the front and rear axles 38 and 40. A resilient latch 48 secures roll support member 46 to the undercarriage 30. Latch 48 is located at an end of roll support member 46 distal the rear axle 38. The latch 48 comprises a resilient, inverted U-shaped member 49 which is integral with roll support member 46. The U-shaped member 49 is provided with a detent or notch 51. An edge 53 of the undercarriage seats in the detent to secure support member 46 to the undercarriage.

The applicator roll 18 comprises a drum 66. An applicator strip 68 surrounds the outer circumference of drum 66. The applicator strip 68 is formed from an elastomeric material. The strip is capable of carrying or being embossed with messages, symbols or the like. A bearing 58 is coaxial with and may be an integral part of the drum 66.

A shaft 56 is journaled in bearing 58. The drum 66 is freely rotatable upon shaft 56. The shaft 56 provides a horizontal rotary axis for the applicator roll 18. A screw 26 is coaxial with the shaft 56. Shaft 56 is an integral part of a roll cover 54. Roll cover 54 is slideably mounted on posts 50.

A leaf spring 62 is mounted on the interior of body housing 12 by means of a screw 64. The leaf spring 62 urges roll cover 54 downwardly so that sleeves 70 bottom on roll support member 46. Sleeves 70 are an integral part of the roll cover 54. See FIGS. 6–7. A stop screw 52 is located at the uppermost end of each post 50. The head of the top screw 52 has a diameter slightly greater than the diameter of the post 50. The stop screws 52 limit the upward sliding movement of the sleeves 70 on posts 50.

The roll support member 46 is movable between a first position and a second position. See FIG. 4. The first position of the roll support member 46, in solid lines, shows the roll support member flush within the undercarriage 30 wherein the latch 48 engages the undercarriage 30. The second position of the roll support member 46, in phantom, shows the roll support member 46 hanging freely from the pivot or rear axle 38 wherein latch 48 is disengaged from undercarriage 30. In the second position, the applicator roll 18 is removed from support member 46 and replaced with other applicator rolls (not shown) of like structure which may have different applicator strips.

Referring to FIGS. 6 and 7, there is shown a cam 28 in horizontal and vertical orientation. The horizontal orientation of cam 28 (FIG. 6) corresponds to the operative position of applicator roll 18. The vertical orientation of cam 28 (FIG. 7) corresponds to the inoperative position of applicator roll 18. The keyway 22 is cut or molded into cam 28. The cam 28 is generally rectangular having rounded corners. The cam 28 is mounted on the roll cover 54 by screw 26 so as to be rotatable about an axis which is co-axial with shaft 56. The cam 28 rests on a follower surface 60. The follower surface 60 is an integral portion of roll support member 46. The interaction of cam 28 and follower surface 60 moves the roll cover 54 up and down on posts 50. The up and down movement of roll cover 54 displaces applicator roll 18 between operative and inoperative positions.

In operation, key 24 is inserted into keyway 22 of cam 28. When it is desired that the applicator roll 18 be in the operative position, the key 24 is turned to the horizontal orientation. See FIG. 2. Spring 62 urges the roll cover 54 so as to ride downwardly on posts 50, with sleeves 70 bottomed on support member 46 such that the applicator strip is in contact with surface 11. When it is desired that the applicator roll 18 be in the inoperative position, the key 24 is turned to the vertical orientation. See FIG. 1. As key 24 turns, cam 28 contacts follower surface 60 and spring 62 yields as roll cover 54 rides upwardly on posts 50. Applicator roll 18 is therefore displaced inwardly with respect to body housing 12 such that the applicator strip is spaced from surface 11.

The toy vehicle 10 may be used as a push toy when the applicator roll 18 is in the inoperative position and as a stamp when applicator roll 18 is in the operative position. To use the vehicle as a stamp, applicator roll 18 is first rolled over an ink pad or the like (not shown). The vehicle body is then pressed toward a support surface so that the front and rear wheels contact the surface. The front and rear wheels and inked applicator roll 18 are then rolled across the surface, thereby transferring the message, symbol or the like carried by the strip onto the surface. Interchangable applicator rolls may be supplied with the toy vehicle 10 thereby increasing versatility. Preferably, all parts are lightweight plastic other than the wheel axles and spring which are metal.

The present invention may be embodied in other specific forms without departing from the spirit or essential attributes thereof. Accordingly, reference should be made to the appended claims, rather to the foregoing specification as indicating the scope of the invention.

I claim:

1. A toy vehicle comprising a body housing, front and rear wheels mounted on said body housing, an undercarriage secured to said body housing, a roll support member pivotably coupled to the undercarriage and latchable thereto, said roll support member including a shaft upstanding from said member and a roll cover slideably mounted on said shaft, an applicator roll supported for rotation about a horizontal axis, means for supporting said applicator roll for rotation about said horizontal axis, and means for selectively displacing said applicator roll between operative and inoperative positions.

2. The toy vehicle according to claim 1 wherein said means for selectively displacing said applicator roll between said operative and inoperative positions comprises a cam.

3. The toy vehicle according to claim 2 including a key for moving said cam so as to selectively displace said applicator roll between said operative and inoperative positions.

4. The toy vehicle according to claim 1 wherein said applicator roll horizontal axis is disposed in elevation above the axes of said front and rear wheels.

5. The toy vehicle according to claim 1 wherein said roll support member is provided with resilient means for releasably latching said support member and undercarriage.

6. The toy vehicle according to claim 1 wherein said applicator roll is releasably mounted on said means for supporting said applicator roll.

7. The toy vehicle according to claim 6 wherein said applicator roll is slidably mounted on said horizontal axis so as to be interchangeable.

8. The toy vehicle according to claim 1 further comprising biasing means affixed to said body housing and being in contact with said roll cover.

9. A toy comprising a body housing, an undercarriage secured to said body housing, a roll support member, an applicator roll rotatably supported by said roll support member, said roll support member including a shaft upstanding from said member and a roll cover slideably mounted on said shaft, said roll support member being pivotably mounted on said undercarriage and means for selectively moving said applicator between first and second positions.

10. The toy vehicle according to claim 9 wherein said means for selectively moving said roll comprises a cam.

11. The toy vehicle according to claim 10 including a key for moving said cam with respect to a narrow surface on said support member.

12. Toy vehicle according to claim 11 wherein said applicator roll is releasably mounted on said roll support member.

13. The toy vehicle according to claim 9 further comprising biasing means affixed to said body housing and being in contact with said roll cover.

* * * * *